US008089421B2

(12) United States Patent
Leisten et al.

(10) Patent No.: US 8,089,421 B2
(45) Date of Patent: Jan. 3, 2012

(54) DIELECTRICALLY LOADED ANTENNA

(75) Inventors: Oliver Paul Leisten, Northamptonshire (GB); Nicholas Roger Padfield, Warwickshire (GB)

(73) Assignee: Sarantel Limited, Wellingborough (GB)

( * ) Notice: Subject to any disclaimer, the term of this patent is extended or adjusted under 35 U.S.C. 154(b) by 415 days.

(21) Appl. No.: 12/465,395

(22) Filed: May 13, 2009

(65) Prior Publication Data

US 2009/0315806 A1 Dec. 24, 2009

Related U.S. Application Data

(63) Continuation-in-part of application No. 11/970,740, filed on Jan. 8, 2008, now Pat. No. 7,903,044.

(60) Provisional application No. 61/106,654, filed on Oct. 20, 2008.

(30) Foreign Application Priority Data

May 13, 2008 (GB) ..... 0808661.3

(51) Int. Cl.
*H01Q 1/36* (2006.01)

(52) U.S. Cl. ..... 343/895; 343/850

(58) Field of Classification Search ..... 343/895, 343/850, 853, 702

See application file for complete search history.

(56) References Cited

U.S. PATENT DOCUMENTS

| | | | | |
|---|---|---|---|---|
| 3,503,075 | A | 3/1970 | Gerst | |
| 4,008,479 | A | 2/1977 | Smith | |
| 4,011,567 | A | 3/1977 | Ben-Dov | |
| 5,828,348 | A | 10/1998 | Tassoudji et al. | |
| 5,990,847 | A | 11/1999 | Filipovic et al. | |
| 6,072,441 | A | 6/2000 | Tanabe | |
| 6,278,415 | B1 | 8/2001 | Matsuyoshi et al. | |
| 6,300,917 | B1 * | 10/2001 | Leisten et al. | 343/895 |
| 6,369,776 | B1 | 4/2002 | Leisten et al. | |
| 6,421,029 | B1 | 7/2002 | Tanabe | |
| 6,424,316 | B1 * | 7/2002 | Leisten | 343/895 |
| 6,608,604 | B1 | 8/2003 | Sharaiha et al. | |
| 6,886,237 | B2 | 5/2005 | Leisten et al. | |

(Continued)

FOREIGN PATENT DOCUMENTS

EP 0 427 654 A1 5/1991

(Continued)

OTHER PUBLICATIONS

S.H. Zainud-Deen et al.; *Investigation of an Octafilar Helix Antenna*; Nineteenth National Radio Science Conference; Mar. 19-21, 2002; pp. 72-80; Alexandria.

(Continued)

*Primary Examiner* — Hoang V Nguyen
(74) *Attorney, Agent, or Firm* — Alston & Bird LLP

(57) ABSTRACT

A dielectrically loaded multifilar antenna has an electrically insulative solid core bearing an antenna element structure having four pairs of substantially helical radiating elements spaced apart around a central axis of the antenna. Each pair of oppositely located antenna elements forms part of a conductive loop having an effective electrical length in the region of N guide wavelengths at the operating frequency, where N is an integer and is at least 2. Typically, each helical element executes substantially a full turn around the axis on the outer surface of the core. The antenna offers an improved gain-bandwidth product compared with typical prior dielectrically loaded multifilar helical antennas, and a 3 dB beamwidth of at least 90° for circularly polarized radiation.

25 Claims, 4 Drawing Sheets

U.S. PATENT DOCUMENTS

| | | | | |
|---|---|---|---|---|
| 6,914,580 | B2 * | 7/2005 | Leisten | 343/895 |
| 7,002,530 | B1 | 2/2006 | Chung et al. | |
| 7,372,427 | B2 * | 5/2008 | Leisten | 343/895 |
| 7,633,459 | B2 * | 12/2009 | Christie et al. | 343/895 |
| 2003/0184496 | A1 | 10/2003 | Louvigne et al. | |
| 2006/0022891 | A1 | 2/2006 | O'Neill, Jr. et al. | |
| 2006/0125712 | A1 | 6/2006 | Sharaiha et al. | |

FOREIGN PATENT DOCUMENTS

| | | | |
|---|---|---|---|
| EP | 1 041 671 | A1 | 10/2000 |
| EP | 0 896 385 | B1 | 10/2001 |
| EP | 0 917 241 | B1 | 6/2002 |
| EP | 1 643 594 | A2 | 4/2006 |
| GB | 2 292 638 | A | 2/1996 |
| GB | 2 309 592 | A | 7/1997 |
| GB | 2 310 543 | A | 8/1997 |
| GB | 2 317 057 | A | 3/1998 |
| GB | 2 338 605 | A | 12/1999 |
| GB | 2 346 014 | A | 7/2000 |
| GB | 2 351 850 | A | 1/2001 |
| GB | 2 367 429 | A | 4/2002 |
| GB | 2 399 948 | A | 9/2004 |
| GB | 2 419 037 | A | 4/2006 |
| GB | 2 424 521 | A | 9/2006 |
| GB | 2 441 566 | A | 3/2008 |
| GB | 2 442 998 | A | 4/2008 |
| GB | 2 445 478 | A1 | 7/2008 |
| WO | WO 99/26316 | A1 | 5/1999 |
| WO | WO 00/39887 | A1 | 7/2000 |
| WO | WO 2006/045769 | A1 | 5/2006 |
| WO | WO 2006/136809 | A1 | 12/2006 |
| WO | WO 2006/136810 | A1 | 12/2006 |
| WO | WO 2008/084205 | A1 | 7/2008 |

OTHER PUBLICATIONS

British Search Report for GB 0700276.9; Filed Jan. 8, 2007.
The British Search Report for Application No. GB 0800222.2; Date of Search Apr. 18, 2008.
Search Report for GB0808661.3 dated Aug. 29, 2008.
International Search Report for PCT/GB2009/001719 dated Jul. 24, 2009.

* cited by examiner

DIELECTRICALLY LOADED ANTENNA

CROSS-REFERENCE TO RELATED APPLICATIONS

This application is a continuation-in-part of currently U.S. patent application Ser. No. 11/970,740 filed Jan. 8, 2008 now U.S. Pat. No. 7,903,044. This application also claims the benefit of the filing date of U.S. Provisional Patent Application Ser. No. 61/106,654 filed Oct. 20, 2008. The entire contents of the '740 and '654 applications are hereby expressly incorporated herein by reference.

BACKGROUND OF THE INVENTION

This application relates to a dielectrically-loaded antenna for operation at frequencies in excess of 200 MHz, and to a portable wireless terminal incorporating such an antenna.

Such antennas are disclosed in a number of patent publications of the present applicant, including GB2292638A, GB2309592A, GB2310543A, GB2338605A, GB2346014A GB2351850A, and GB2367429A. Each of these antennas has at least one pair of diametrically opposed helical antenna elements which are plated on a substantially cylindrical electrically insulative core made of a material having a relative dielectric constant greater than 5. The material of the core occupies the major part of the volume defined by the core outer surface. Extending through the core from one end face to an opposite end face is an axial bore containing a coaxial feeder structure that comprises an inner conductor surrounded by a shield conductor. At one end of the bore the feeder structure conductors are connected to respective antenna elements which have associated connection portions adjacent the end of the bore. At the other end of the bore, the shield conductor is connected to a conductor which links the antenna elements and, in each of these examples, is in the form of a conductive sleeve encircling part of the core to form a balun. Each of the antenna elements terminates on a rim of the sleeve and each follows a respective helical path from its connection to the feeder structure.

Some of the above prior patent publications disclose quadrifilar helical antennas intended primarily for receiving or transmitting circularly polarized electromagnetic waves. Each of these antennas has four helical tracks plated on the cylindrical surface of the core, or four groups of helical tracks, each group forming a composite antenna element and comprising two tracks separated by a narrow slit.

Whether the antenna has four helical antenna elements or two, the connection portions connecting the antenna elements to the feed structure conductors are radial tracks plated on a planar end surface of the core.

It is known to provide a quadrifilar helical antenna with an impedance-matching network. This may be embodied as a small printed circuit or laminate board secured to the top end face of the core where it provides coupling between the feeder structure and radial connection portions such as those disclosed in the above-mentioned prior patent publications. An antenna having such a matching network is disclosed in International Patent Application Publication No. WO 2006/136809.

International Patent Application Publication No. WO 2008/084205 published on Jul. 17, 2008 discloses dielectrically loaded antennas having, respectively, three and four pairs of diametrically opposed helical antenna elements. The disclosures of this application and each of the prior patent publications referred to above are specifically incorporated in this specification by reference.

It is an object of the present invention to provide an antenna with an improved gain-times-bandwidth product.

BRIEF SUMMARY OF THE INVENTION

According to a first aspect of the invention, a dielectrically loaded multifilar antenna having an operating frequency in excess of 200 MHz comprises an electrically insulative core of a solid material that has a relative dielectric constant of at least 10 and occupies the major part of the interior volume defined by the core outer surface, and a three-dimensional antenna element structure that is on or adjacent the core outer surface and that comprises at least two pairs of substantially helical conductive antenna elements, the antenna elements being spaced around an axis of the antenna. Each such pair of antenna elements forms part of a conductive loop having an effective electrical length in the region of N wavelengths at the operating frequency, where N is an integer and is at least two. Typically, each substantially helical element has an electrical length of N/2 wavelengths and, conveniently, executes substantially one full turn about the antenna axis. Preferably, the antenna elements are substantially uniformly spaced around the antenna axis. They are also preferably axially coextensive. The antenna has a far-field 3 dB beamwidth of at least 90° for circularly polarized radiation and, typically, achieves a beamwidth of 120°. Advantageously the relative dielectric constant of the solid material is at least 20, with the preferred material being calcium magnesium titanate, a material which has a relative dielectric constant of 21. In this way, it is possible to construct an antenna achieving a zenith gain in the region of +3 dB relative to isotropic for circularly polarized radiation.

One embodiment in accordance with the invention has an antenna element structure with at least three pairs of substantially helical full-turn antenna elements. In this embodiment, the core has a cylindrical outer surface portion, a first end surface portion, and a second end surface portion oppositely directed with respect to the first end surface portion. Each pair of helical antenna elements comprises two elongate conductive elements plated or otherwise bonded to the cylindrical outer surface portion of the core in a diametrically opposed configuration. The antenna has an axially located feeder structure with a central feeder connection associated with the first end surface portion. In one such embodiment, the axial feeder structure passes through the core so that the antenna constitutes a so-called "backfire" antenna.

The antenna element structure of the antenna in one embodiment includes a plurality of radially extending connection elements on or adjacent the first end surface portion, each coupling a respective one of the helical elements to the central feeder connection, the lengths of the radially extending connecting elements being different for each said pair of helical antenna elements in order that the electrical length of the conductive loop containing each respective said pair is different.

The antenna is resonant in a circularly polarized mode of resonance at the operating frequency, the resonant mode being characterized by a rotating dipole, and voltage maxima being excited on each of the elongate antenna elements in succession in the direction of rotation.

The antenna in one embodiment of the invention includes a pair of antenna element coupling nodes, each of the pairs of substantially helical elements having one antenna element connected to one of the coupling nodes and another antenna element connected to the other coupling node. The antenna also has a common interconnecting conductor for the helical antenna elements, advantageously in the form of a conductive ring interconnecting ends of the elongate conductive elements. This conductor may encircle the axis and lie generally in plane extending perpendicularly to the axis. In one embodiment, this interconnecting conductor encircles the core on the outer cylindrical surface portion thereof and defines a resonant conductive path around the core. Each helical antenna element has a first end connected to one or the other of the coupling nodes and a second end connected to the common interconnecting conductor, the connections of the second ends being at equally spaced connection points.

Advantageously the electrical length of the annular conductive path formed by the common interconnecting conductor encircling the core is substantially equal to a whole number (1, 2, 3, . . . ) of guide wavelengths corresponding to the operating frequency of the antenna. This enhances the circularly polarized resonant mode of the antenna since the common interconnecting conductor has a ring resonance at the operating frequency, promoting the progression of the rotating dipole around the uniformly spaced-apart helical antenna elements.

The common interconnecting conductor may be a narrow annular conductive track, both edges of which are on the outer side surface portion of the core. Such a configuration is particularly suitable for an endfire multifilar helical antenna. Alternatively, the common interconnecting conductor may be constituted by a conductive sleeve that surrounds the core and extends over the second end surface portion to make a connection, in this case, with the shield conductor of a coaxial transmission line feeder structure. This feeder structure passes through the core to connections with the helical antenna elements at an opposite end surface portion of the core. Such a sleeve may form an integral balun, as described in the above-referenced prior patent publications of the present applicant.

The ends of the helical antenna elements are preferably equiangularly spaced around the central axis, the physical spacings being equal to the differences in phase between voltages and currents on the respective elements. In general, the physical angular spacing between successive helical antenna elements does not vary by more than 2:1, at both the ends of the helical elements and at locations between their ends.

In one embodiment of the invention, the helical antenna elements are pure helices of substantially equal length and equal pitch. Especially with a common interconnecting conductor exhibiting a ring resonance at the operating frequency, phasing of the currents and voltages in the elongate antenna elements may not be entirely dependent on the electrical lengths of such elements. In the described embodiments, however, phasing of the elements may be achieved as mentioned above by arranging for the radially extending connecting elements on the first end surface portion to be different for each pair of helical antenna elements. For instance, in an antenna having four pairs of helical antenna elements located on a cylindrical outer surface portion of the core, the four first antenna elements are located next to each other to form a first group of antenna elements and the four second antenna elements are located next to each other to form a second group of antenna elements, the antenna elements of each group being connected to respective coupling nodes for coupling the antenna elements to the feeder structure. In this case, the radially extending connecting elements of each group vary progressively and monotonically, the sense of the progression being the same for each group so as to create, for each group, a monotonic progression around the core in the lengths of the conductive loops. It follows that each helical element and its corresponding connecting element together form a conductor yielding a respective predetermined electrical path length between the respective coupling node and the other end of the helical antenna element which is connected to the interconnecting conductor surrounding the core adjacent the second end surface portion of the core.

The radially extending connecting elements can be formed as part of a conductive foil on or adjacent the first end surface portion of the core, the foil having two inner conductive arcs each interconnecting the radially extending connecting elements associated with the respective one of the groups of helical antenna elements. The antenna can include an impedance-matching network constructed as a laminate board having conductive layers electrically connected to the inner conductive arcs referred to above.

The ends of the helical antenna elements remote from the radially extending connecting elements are linked in one embodiment. In this embodiment, each helical antenna element of each pair of such elements has a first end coupled to a respective one of the coupling nodes and a second end that is linked to the second end of the other helical antenna element of the pair to form at least part of a conductive loop that is generally symmetrical about the axis and that has a predetermined resonant frequency. The loops formed by such pairs of helical antenna elements are angularly distributed with respect to the axis, the respective resonant frequencies of the loops varying monotonically with angular orientation about the axis. In such a case, the second ends of the helical antenna elements may be linked by the common interconnecting conductor encircling the core, such that their second ends are defined by the connections of the elements to a common annular edge of the interconnecting conductor. This edge, linking the helical elements, may lie substantially in a plane perpendicular to the antenna axis.

It will be noted that in some embodiments of the invention, phasing of currents and voltages on the helical antenna elements is achieved by conductors on the core, rather than using an external network.

One particular embodiment of the invention takes the form of an octafilar helical antenna having four pairs of elongate helical antenna elements on a cylindrical surface portion of the core, the angular spacing of neighbouring such elements being 45° at the cylinder axis. Preferably, each helical element executes substantially a full turn about the axis.

The helical elements can comprise conductive tracks on the core outer side surface portion. They may be pure helices or they may deviate from a pure helical path, e.g., by being meandered. It is also possible to alter their electrical length, in each case, by meandering, for instance, only one of the edges, or by meandering the two edges of the track at different amplitudes. It is to be noted that efficiency of an octafilar antenna is greater than that associated with an equivalent quadrifilar antenna because the number of conductive track edges of the radiating structure is greater. At typical operating frequencies of such antennas, currents tend to be confined to the edges or peripheries of conductors. It follows that increasing the number of edges connected in parallel reduces ohmic losses and hence increases efficiency. By arranging for each pair of helical antenna elements to form a conductive loop having an electrical length that is twice or more than twice the guide wavelength, the volume of the antenna is increased compared with the octafilar antenna disclosed in applicant's co-pending application GB0800222.2. It has been found that this increased volume further increases the efficiency of the antenna without reducing its beamwidth. This is contrary to the normally observed effect insofar as helical antennas usually become more directional as the number of turns is increased. It is thought that the antenna of the present invention exhibits little or no reduction in beamwidth because, despite having electrically longer conductive loops, the radiating length of the antenna, i.e., the axial extent of the helical antenna elements, is still small compared with the wavelength λ, in air, owing to the comparatively high relative dielectric constant of the core material. Preferably, the radiating length is less than λ/4. In the most preferred embodiment of the invention, the radiating length is less than λ/6.

Efficiency is maximized if the spacing between the helical elements of each pair, measured perpendicularly to the axis, is about one-half of the average axial extent of the helical elements or the radiating length of the antenna.

In this way, it is possible to achieve a gain at the zenith (i.e., on the antenna axis) of +3 dB against isotropic for circularly polarized radiation. Such a gain in efficiency can be used to yield improved sensitivity for receiving equipment and greater effective transmitted power for transmitting equipment without significantly compromising beamwidth.

Meandering of the helical elements may be used as a way of varying the respective electrical lengths of the elements to aid phasing of currents and voltages. It is also possible to vary the lengths of the helical elements relative to each other by forming the common interconnecting conductor, e.g., the conductive sleeve, with a non-planar edge to which the helical elements are connected. It is possible to combine both of these features, or either or both of them with the above-mentioned variation of the lengths of the radially extending connecting elements, in order to achieve a larger variation in relative length than can be achieved with a single such technique.

A particular application for this antenna is in a satellite radiotelephone, e.g., using the Iridium system, which has an operating band of 1616 MHz to 1626.5 MHz.

The embodiments described herein also include a portable wireless communication terminal having an antenna as described above.

Embodiments of the invention are described below by way of example with reference to the drawings.

DETAILED DESCRIPTION OF THE DRAWINGS

Figure 1:
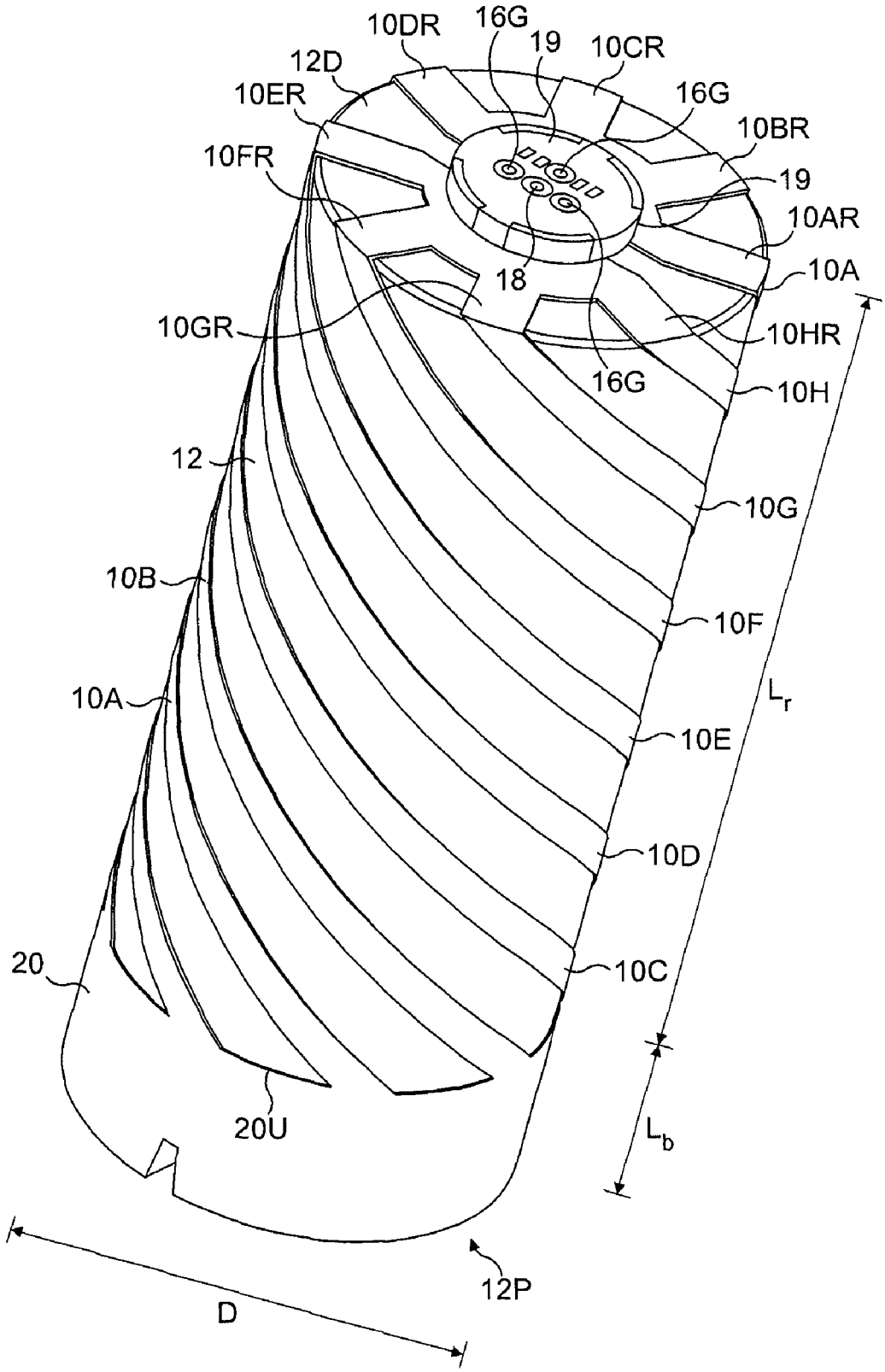
FIG. 1 is a perspective view of an antenna in accordance with the invention.
Figure 2:
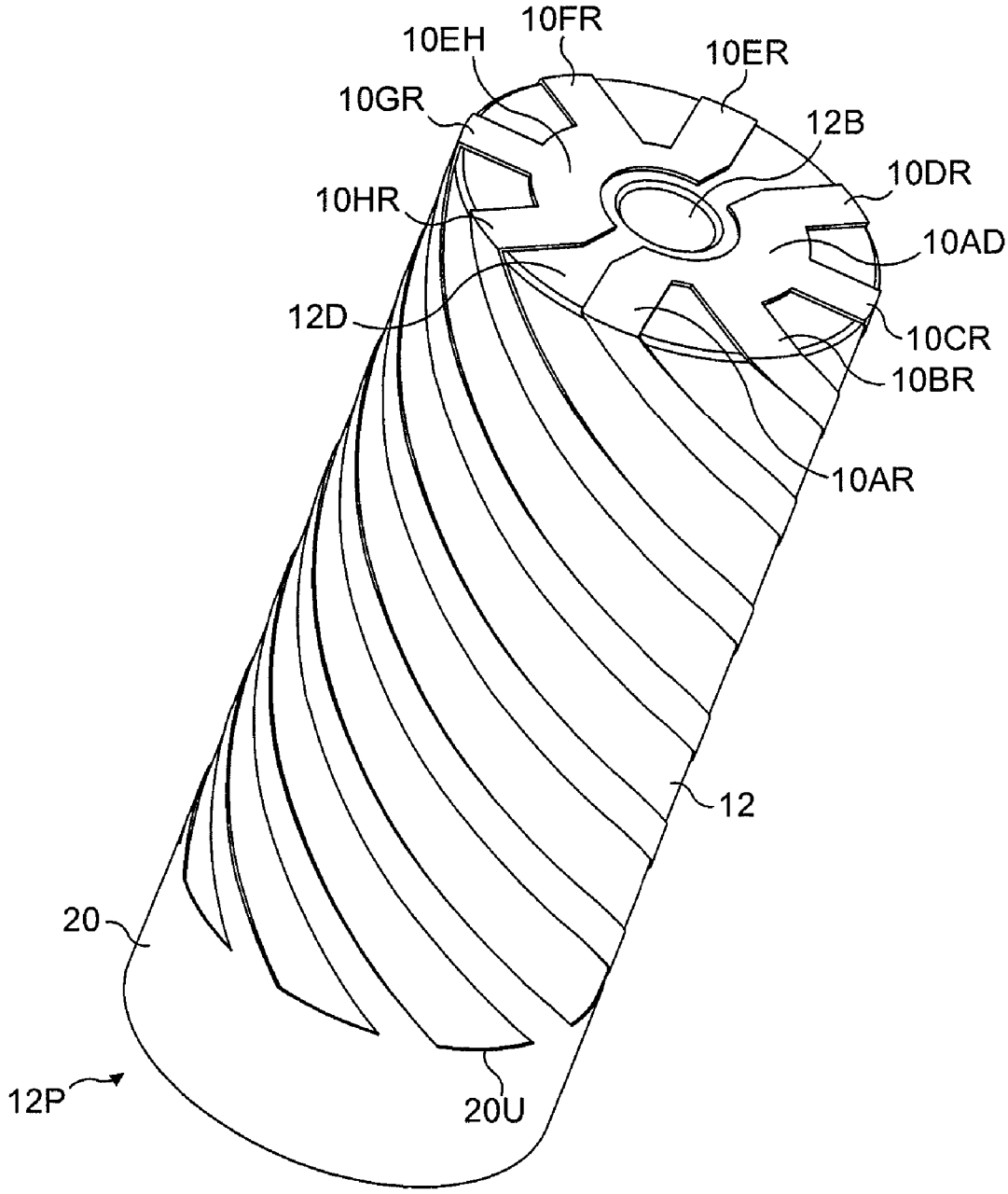
FIG. 2 is a perspective view of a plated antenna core of the antenna of FIG. 1, viewed from a distal end and one side.

Referring to FIGS. 1 and 2, an octafilar helical antenna in accordance with the invention has an antenna element structure with eight elongate antenna elements in the form of eight axially coextensive helical conductive tracks 10A, 10B, 10C, 10D, 10E, 10F, 10G, 10H plated or otherwise metallized on the cylindrical outer surface portion of a cylindrical core 12. The core is made of a ceramic material. In this case it is a calcium magnesium titanate material having a relative dielectric constant in the region of 21. This material is noted for its dimensional and electrical stability with varying temperature. Dielectric loss is generally negligible. In this embodiment, the core has a diameter D of 14 mm. The length of the core is more than twice the diameter but, in other embodiments of the invention, it may be less than this. The core is produced by pressing, but may be produced in an extrusion process, the core then being fired.

This exemplary antenna is a backfire helical antenna in that it has a coaxial transmission line housed in an axial bore 12B that passes through the core from a first end surface portion in the form of a distal end face 12D to a second end surface portion in the form of a proximal end face 12P of the core. Both end faces 12D, 12P are planar and perpendicular to the central axis of the core. The coaxial transmission line is a rigid coaxial feeder that is housed centrally in the bore 12B with the outer shield conductor spaced from the wall of the bore 12B so that there is, effectively, a dielectric layer between the shield conductor and the material of the core 12.

Figure 3:
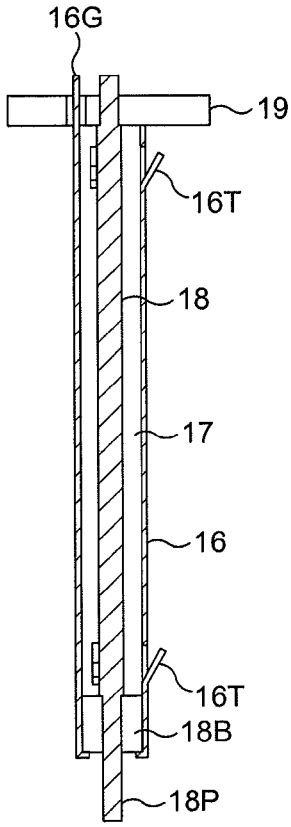
FIG. 3 is an axial cross-section of a feeder structure of the antenna of FIG. 1.

Referring to FIG. 3, the coaxial transmission line feeder has a conductive tubular outer shield conductor 16, a first tubular air gap or insulating layer 17, and an elongate inner conductor 18 that is insulated from the shield conductor by the insulating layer 17. The shield conductor 16 has outwardly projecting and integrally formed spring tangs 16T or spacers that space the shield from the walls of the bore 12B. A second tubular air gap exists between the shield conductor 16 and the wall of the bore 12B. The insulative layer 17 may, instead, be formed as a plastics sleeve, as may the layer between the shield conductor 16 and the walls of the bore 12B. At the lower, proximal end of the feeder, the inner conductor 18 is centrally located within the shield conductor 16 by an insulative bush 18B.

The combination of the shield conductor 16, inner conductor 18, and insulative layer 17 constitutes a transmission line of predetermined characteristic impedance, here 50 ohms, passing through the antenna core 12 for coupling distal ends of the antenna elements 10A to 10H to radio frequency (RF) circuitry of equipment to which the antenna is to be connected. The couplings between the antenna elements 10A to 10H and the feeder are made via conductive feed connection portions associated with the helical tracks 10A to 10H, these connection portions being formed as radial tracks 10AR, 10BR, 10CR, 10DR, 10ER, 10FR, 10GR, 10HR plated on the distal end face 12D of the core 12 (see FIGS. 1 and 2). Each feed connection portion extends from a distal end of the respective helical track to one of two inner arcuate conductors 10AD, 10EH plated on the core distal face 12D adjacent the end of the bore 12B.

The two arcuate conductors 10AD, 10EH are connected, respectively, to the shield and inner conductors 16, 18 by conductors on a laminate board 19 secured to the core distal face 12D, as will described hereinafter. The coaxial transmission line feeder and the laminate board 19 together comprise a unitary feed structure before assembly into the core 12, and their interrelationship may be seen by comparing FIGS. 1, 2, and 3.

Referring again to FIG. 3, the inner conductor 18 of the transmission line feeder has a proximal portion 18P that projects as a pin from the proximal face 12P of the core 12 for connection to the equipment circuitry. Similarly, integral lugs (not shown) on the proximal end of the shield conductor 16 project beyond the core proximal face 12P for making a connection with the equipment circuitry ground.

As shown in FIG. 1, the proximal ends of the antenna elements 10A-10H are inter-connected by a common virtual ground conductor 20. In this embodiment, the common conductor is annular and in the form of a plated sleeve surrounding a proximal end portion of the core 12 adjacent the proximal face 12P. This sleeve 20 is, in turn, connected to the shield conductor 16 of the feeder by a plated conductive covering (not shown) of the core proximal end face 12P so as to form a quarter-wave balun, as described in the above-mentioned prior patent publications.

The eight helical antenna elements 10A-10H constitute four pairs 10A, 10E; 10B, 10F; 10C, 10G; 10D, 10H of such elements, each pair having one helical element coupled to one of the arcuate conductors 10AD, 10EH and another, diametrically opposed, helical element coupled to the other of the arcuate conductors 10EH, 10AD, and thence, respectively, to the inner conductor 18 and shield conductor 16 of the transmission line feeder. In effect, therefore, the eight helical antenna elements 10A-10H may be regarded as being arranged in two groups of four 10A-10D, 10E-10H, all of the elements 10A-10D of one group being coupled to the first arcuate conductor 10AD and all of the elements 10E-10H of the other group being coupled to the second arcuate conductor 10EH. Thus, the two arcuate conductors constitute first and second coupling nodes that interconnect the respective helical antenna elements, and provide common connections for the elements of each group to one or other of the conductors of the transmission line feeder.

It follows that each such pair of helical elements 10A, 10E; 10B, 10F; 10C, 10G; 10D, 10H, together with its corresponding pair of feed-connection radial elements 10AR, 10ER; 10BR, 10FR; 10CR, 10GR; 10DR, 10HR, and the rim 20U of the sleeve 20, forms a conductive loop between the two coupling nodes. In this antenna, the electrical length of this conductive loop is $2\lambda_g$, where $\lambda_g$ is the guide wavelength of currents travelling along the conductors of the loop at the operating frequency of the antenna. Each helical element of the pair executes a full turn, to within plus or minus 15 per cent, around the antenna axis so that the pair of elements, together with the radial feed-connection elements and the rim, form a twisted loop, the total angle of the twist being about 360°. The present antenna exhibits little or no deterioration of beamwidth compared with an octafilar antenna having a loop length of $\lambda_g$ and half-turn helical elements. However, owing to the approximate doubling in volume of the antenna (compared with an octafilar antenna with $\lambda_g$ loops and the same core diameter) a significant increase in the gain-times-bandwidth product is achieved.

As to the smallness of the antenna in relation to the operating wavelength in air, in this embodiment the radiating length, $L_r$ (i.e., the average axial extent of the helical elements 10A-10H of the antenna-see FIG. 1), is about 0.15λ, λ being the wavelength in air. At 1621 MHz, in the Iridium satellite radiotelephone band, 0.15λ equates to about 28.5 mm. For an antenna operating at this frequency, the axial length, $L_b$, of the balun sleeve 20 is about 4.5 mm, yielding a total antenna length of about 33 mm. The aspect ratio of the radiating part of the antenna, i.e., the radiating length $L_r$ divided by the diameter D, is about 2. In general, the preferred aspect ratio is equal to the number of wavelengths represented by the electrical length of the conductive loop formed by each pair of helical elements and corresponding radial feed-connection elements.

It has been stated above that the conductive loops formed by the pairs of helical elements and their corresponding radial feed-connection elements is twice the wavelength (i.e., an electrical length of 720°). In practice, this is the average length of the conductive loops, each respective loop having a slightly differently length compared with its neighbours in order to obtain a progression of individual resonant frequencies from pair to pair. Accordingly, at the operating frequency, there are phase shifts between the currents in respective successive pairs of elements, these phase shifts giving rise to the resonance of the antenna in respect of circularly polarized waves, in the same way that 90° phase shifts from element to element in conventional quadrifilar helical antennas creates a resonance for circularly polarized waves. The applicants have found that the best results are obtained if the eight helical antenna elements 10A-10H are of the same length or similar lengths, the variation in loop lengths from helical pair to helical pair being achieved by varying the lengths of the radial feed-connection elements 10AR, 10ER; 10BR, 10FR; 10CR, 10GR; 10DR, 10HR, as best seen in FIGS. 2 and 4.

Figure 4:
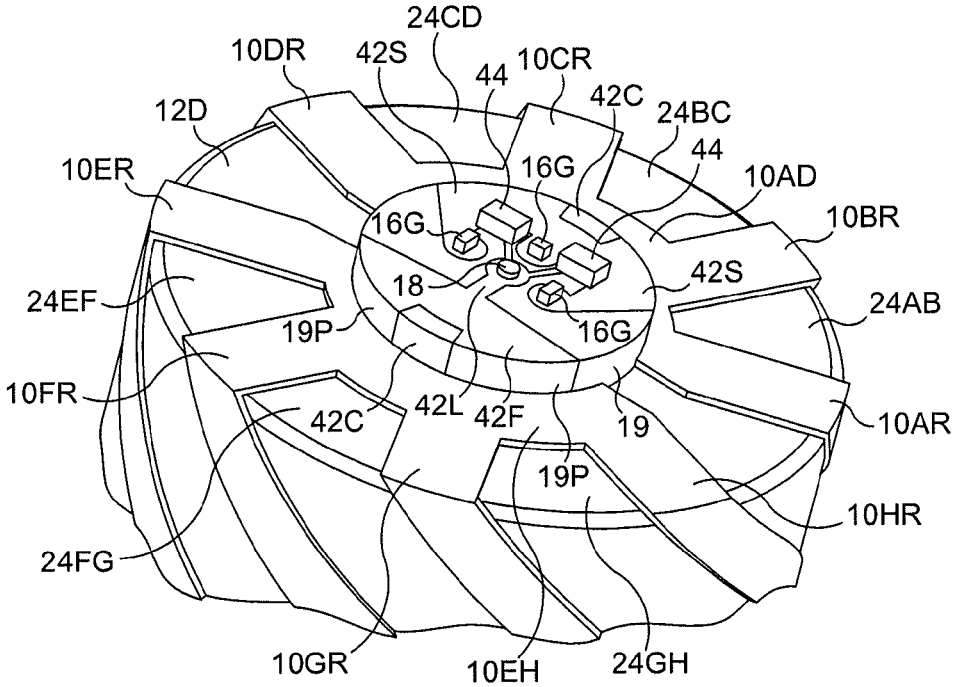
FIG. 4 is a more detailed perspective view of a distal end portion of the antenna of FIG. 1, showing a matching network on a laminate board of the feeder structure.

Referring to FIGS. 2 and 4, the radial feed-connection elements 10AR-10HR interconnect the helical elements 10A-10H and the respective inner arcuate conductors 10AD, 10EH, which form a pair of coupling nodes, as described above. The radial feed-connection elements and the inner arcuate elements are formed as a single conductive layer plated directly on the distal end face 12D of the core. As will be seen, a first 180°-opposite pair 10AR, 10ER of the radial elements is generally longer than the next pair 10DR, 10FR in the anti-clockwise direction, and so on to the generally shortest pair of elements 10BR, 10HR. More precisely, it is the lengths of the edges of the radial elements 10AR-10HR that vary. That is, the spaces 24AB, 24BC, 24CD, 24EF, 24FG, 24GH between neighboring radial elements are in the shape of truncated sectors, the degree of truncation increasing in the anti-clockwise direction within each group 10AR, 10BR; 10CR, 10DR; 10ER, 10FR; 10GR, 10HR of radial elements. If follows that the length of the edges of each consecutive pair of elements is the same but, owing to the difference in the edge lengths of each helical element 10A-10H resulting from the angled junction with the rim 20U (see FIG. 2), the effective lengths of the helical element and radial element combinations 10A, 10AR-10H, 10HR vary monotonically and progressively within each of the two groups of elements. (As will be appreciated by those skilled in the art, it is the lengths of the edges that govern the loop lengths since, at the operating frequency, currents tend to be concentrated at the edges of conductive tracks.)

In this embodiment of the invention, the eight helical antenna elements 10A-10H are of the same lengths or similar lengths. Consequently, the rim 20U of the sleeve 20 is substantially planar, lying substantially in a plane perpendicular to the antenna axis. However, a non-planar rim may be used in some circumstances, as mentioned above.

In summary, therefore, the helical elements 10A-10H of this antenna are equally angularly spaced around the core 12 at intervals of 360°/n, where n is the number of elements, and they are arranged in two groups each having n/2 elements that are of similar length owing to the varying distance of the rim 20U of the sleeve 20 from the distal end face 12D of the core 12, which face is perpendicular to the central axis of the core. Each element executes substantially a full turn of the core in this embodiment.

The conductive sleeve 20 and the plating on the proximal end face 12P of the core form a sleeve balun that, together with the shield conductor 16 of the feeder, provides common-mode isolation of the radiating antenna element structure from the equipment to which the antenna is connected when installed, when the antenna is operated at its operating frequency. Currents in the sleeve are, therefore, confined to the sleeve rim 20U. Accordingly, at the operating frequency, the rim 20U of the sleeve 20 and the helical elements of each pair 10A, 10E-10D, 10H form a respective conductive loop connected to a balanced feed, currents travelling between the elements of each pair via the rim 20U.

In this preferred embodiment of the invention, the circumference of the sleeve is equal to an integer number of guide wavelengths at the operating frequency. This has the effect of reinforcing the resonant mode arising from the resonance of the above-mentioned conductive loops formed by the pairs of helical elements and the rim at the operating frequency. In particular, as described in the above-mentioned British Patent Publication GB2346014A, the sleeve 20 acts as a resonant structure in itself, independently of the helical elements 10A-10H. Thus, the rim 20U of the sleeve, having an electrical length equal to the operating wavelength, is resonant in a ring mode. Reinforcement of the resonant mode due to the loops formed by the pairs of helical elements, the radial feed-connection and the rim 20U can be visualised by imagining a wave being injected onto the ring represented by the rim 20U at the junction of each of the helical elements and the rim, the wave then travelling around the rim 20U to form a spinning dipole, as described in GB2346014A. Owing to the electrical length of the rim 20U, when the injected wave has travelled around the rim 20U and arrives back at the injection point, the next wave is injected from the respective helical element, thereby reinforcing the first. This constructive combination of waves results from the resonant length of the rim.

Further details of the ring resonance and the action of the sleeve 20 and the plating on the proximal end surface 12P of the core in contributing to the operation of the antenna with regard to circularly polarized electromagnetic waves are contained in the above-mentioned GB2346014A. While the sleeve and plating of this embodiment of the invention are advantageous in that they provide both a balun function and a ring resonance, a ring resonance can also be provided independently by connecting the helical elements 10A-10H to an annular conductor that encircles the core 12 and has both proximal and distal edges on the outer side surface portion of the core, rather than being in the form of a sleeve connected to the feeder shield conductor 16 to form an open-ended cavity, as in the present embodiment. Such a conductor may be comparatively narrow insofar as it may constitute an annular track the width of which is similar to the width of conductive tracks forming the helical elements 10A-10H and, providing it has an electrical length corresponding to an integral multiple (1, 2, 3, . . . ) of the guide wavelength at the operating frequency, still produces a ring resonance reinforcing the resonant mode associated with the loops provided by the helical elements and their interconnection.

With regard to the resonant behavior of the loops represented by the helical elements 10A-10H and their interconnections, these combine such that, at the operating frequency of the antenna, it operates in a mode of resonance in which the antenna is sensitive to circularly polarized signals. Each pair 10AE, 10BF, 10CG, 10DH of the helical elements, together with the associated radial elements, has an associated resonance within a single operating frequency band of the antenna, and the pairs all cooperate to form a common circular polarization resonance, as follows. The differing lengths of the helical element and radial element combinations result in 360°/n (45°) phase differences between currents in the different elements of each group 10A-10D, 10E-10H. In this resonant mode, currents flow around the rim 20U between, on the one hand, the helical element of each pair 10A, 10E, 10B, 10F, 10C, 10G, 10D, 10H which is coupled to the inner feed conductor 18 and, on the other hand, that which is connected to the shield conductor 16 by the coupling conductors of the laminate board 19. The sleeve 20 and the plating on the proximal end face 12P of the core together act as a trap preventing the flow of currents from the antenna elements 10A-10H to the shield conductor 16 at the proximal end face 12P of the core.

Operation of dielectrically loaded multifilar helical antennas having a balun sleeve is described in more detail in the above-mentioned British Patent Applications GB2292638A and GB2310543A.

The feeder transmission line performs functions other than simply acting as a line having a characteristic impedance of 50 ohms for conveying signals to or from the antenna element structure. Firstly, as described above, the conductive shield 16 acts in combination with the sleeve 20 to provide common-mode isolation at the point of connection of the feed structure to the antenna element structure. The length of the shield conductor between (a) its connection with the plating 22 on the proximal end face 12P of the core and (b) its connection to conductors on the laminate board 19, together with the dimensions of the bore 12B and the dielectric constant of the material filling the space between the shield conductor 16 and the wall of the bore, are such that the electrical length of the shield conductor 16 on its outer surface is, at least approximately, a quarter wavelength at the frequency of the required mode of resonance of the antenna, so that the combination of the conductive sleeve 20, the plating 22 and the shield conductor 16 promotes balanced currents at the connection of the feed structure to the antenna element structure.

In this exemplary antenna, there is an insulative layer surrounding the shield conductor 16 of the feed structure. This layer, which is generally of lower dielectric constant than the dielectric constant of the core 12 and, in this case, air, diminishes the effect of the core 12 on the electrical length of the shield conductor 16 and, therefore, on any longitudinal resonance associated with the outside of the shield conductor 16. Since the mode of resonance associated with the required operating frequency is characterized by voltage dipoles extending diametrically, i.e., transversely of the cylindrical core axis, the effect of the low dielectric constant sleeve on the required mode of resonance is relatively small because the sleeve thickness is, at least in the preferred embodiment, considerably less than that of the core. It is, therefore, possible to cause the linear mode of resonance associated with the shield conductor 16 to be de-coupled from the wanted mode of resonance.

Further details of the feed structure will now be described with reference to FIGS. 3, 4, 5A, and 5B. The feed structure comprises the combination of a coaxial 50-ohm line 16, 17, 18 and the planar laminate board 19 connected to a distal end of the line. The laminate board 19 is a double-sided printed circuit board (PCB) that lies flat against the distal end face 12D of the core 12 in face-to-face contact. The largest dimension of the PCB 19 is smaller than the diameter of the core 12 so that the PCB 19 is fully within the periphery of the distal end face 12D of the core 12 and is sufficiently small so as not to cover the longest of the radial feed-connection elements 10AR, 10ER, as shown in FIG. 1.

In this embodiment, the PCB 19 is in the form of a disc centrally located on the distal face 12D of the core. Its diameter is such that it overlies the arcuate inter-element coupling conductors 10AD, 10EH plated on the core distal face 12D. As shown in FIG. 4, the PCB has a substantially central hole that receives the inner conductor 18 of the coaxial feeder transmission line. Three off-center holes receive distal lugs 16G of the shield conductor 16. Lugs 16G are bent or "jogged" to assist in locating the PCB 19 with respect to the coaxial feeder structure. All four holes are plated through. In addition, portions 19P of the periphery of the PCB 19 are plated, the plating extending onto the proximal and distal faces of the board.

Figure 5A:
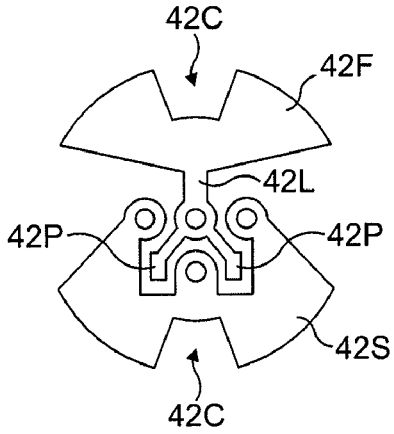
FIGS. 5A and 5B are diagrams showing conductor patterns of conductive layers on distal and proximal faces of the laminate board of the feeder structure.
Figure 5B:
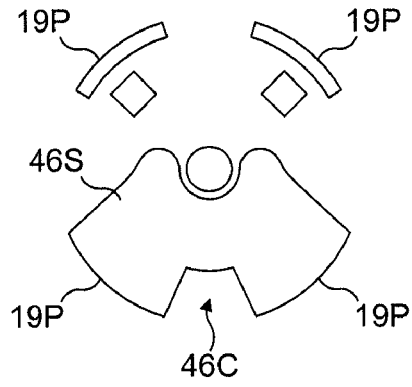

The PCB 19 is double-sided in that it has distal and proximal conductive layers on opposite faces of an intervening insulative layer. Each conductor layer is etched with a respective conductor pattern, as shown in FIGS. 5A and 5B. Where the conductor pattern extends to the peripheral portions 19P of the PCB 19 and to the plated-through holes, the respective conductors in the different layers are interconnected by the edge plating and the hole plating, respectively. As will be seen from FIGS. 5A and 5B, the distal conductive layer has a pair of pads 42P linked to the inner conductor 18 (when seated in the central hole). These pads 42P are surrounded by a fan or sector-shaped conductive area 42S connected to the lugs 16G of the shield 16 of the feeder (when received in their respective plated vias). The pads 42P and the neighbouring areas of the fan-shaped conductor are coupled by a pair of chip capacitors 44 soldered on the distal face of the PCB 19, as shown in FIG. 4. The capacitors together form a shunt capacitance between the inner conductor 18 and the shield conductor 16 of the feeder. Note that the proximal conductive layer (see FIG. 5B) has a corresponding sector-shaped conductive area 46S in registry with sector-shaped area 42S, these two plated areas forming a distributed connection between a shield conductor 16 of the feeder and the arcuate inner conductor 10AD and, therefore, the helical elements 10A-10D. Cut-outs 42C and 46C in the distal and proximal conductive layers respectively are in registry with the gap between radial feed-connection elements 10BR, 10CR and promote distribution of currents amongst the helical elements of the respective group 10A-10D.

The conductor pattern of the distal conductive layer is such that it has a second conductor area 42L extending from the connection with the inner feeder conductor 18 to a second fan or segment-shaped conductive area 42F and thence to the plated outer peripheral portions 19P that overlie the arcuate or part-annular conductor 10EH. Again a cut-out 42C in the segment-shaped area serves in the uniform distribution of currents in the respective helical elements 10E-10H. There is no corresponding underlying conductive area in the proximal conductor layer. The conductive area 42L between the central hole 32 and the plated peripheral portion 19P overlying the arcuate track 10EH acts as a series inductance between the inner conductor 18 of the feeder and the other of the groups of helical antenna elements 10E-10H.

When the combination of the PCB 19 and the elongate feeder 16-18 is mounted to the core 12 with the proximal face of the PCB 19 in contact with the distal face 12D of the core, aligned over the arcuate interconnection elements 10AD and 10EH as described above, connections are made between the peripheral portions 19P and the underlying tracks on the core distal face 12D to form a reactive matching circuit having a shunt capacitance and a series inductance.

Connections between the feeder line 16-18, the PCB 19 and the conductive tracks on the distal face 12D of the core are made by soldering or by bonding with conductive glue. The feeder 16-18 and the PCB 19 together form a unitary feeder structure when the distal end of the inner conductor 18 and the shield lugs 16G are soldered into the respective vias of the PCB 19. The feeder 16-18 and the PCB 19 together form a unitary feed structure with an integral matching network.

The shunt capacitance and the series inductance form a matching network between the coaxial transmission line at its distal end and the radiating antenna element structure of the antenna. The shunt capacitance and the series inductance together match the impedance presented by the coaxial line, physically embodied as shield conductor 16, insulative layer 17, and inner conductor 18, when connected at its proximal end to radio-frequency circuitry having a 50-ohm termination, this coaxial line impedance being matched to the impedance of the antenna element structure at its operating frequency or frequencies.

Figure 6:
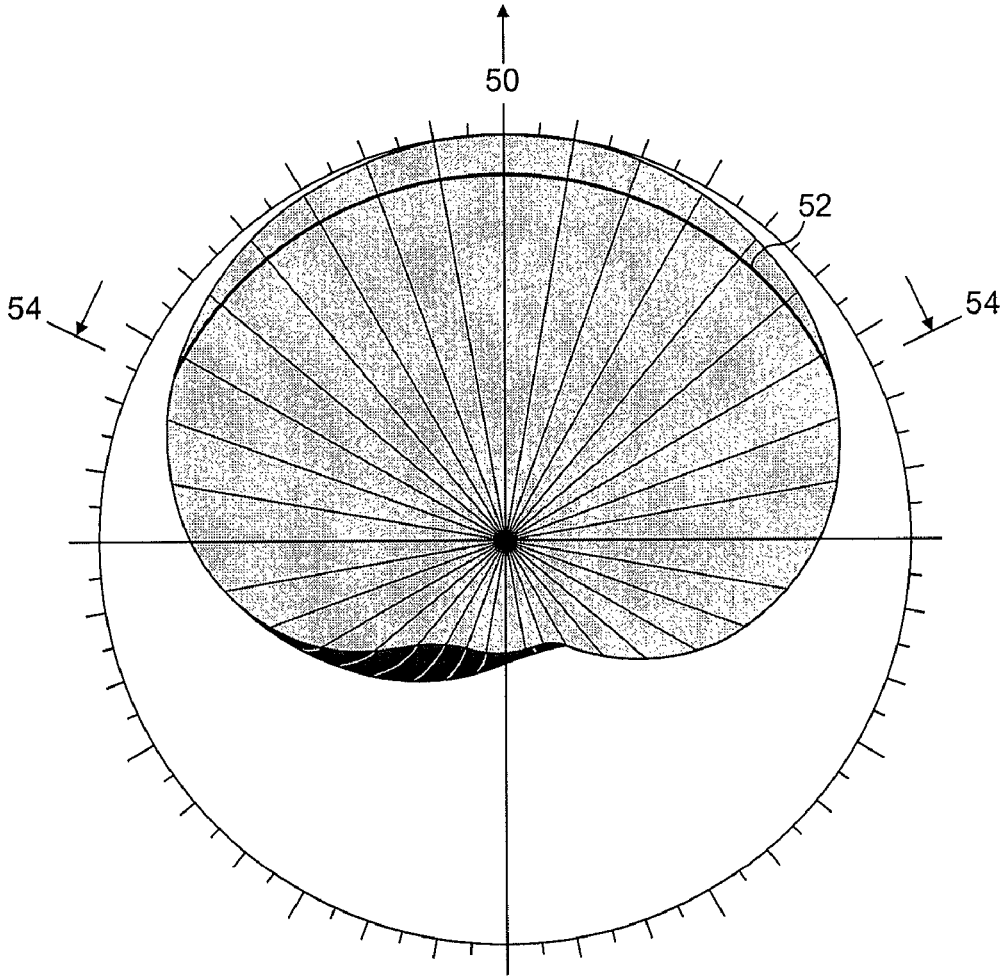
FIG. 6 is a diagram showing the radiation pattern of the antenna.

The far-field radiation pattern produced by the antenna described above at the operating frequency and for circularly polarized radiation is substantially cardioid-shaped, as shown in FIG. 6. At elevation angles greater than about 30°, the antenna is substantially omni-directional, the gain at the zenith 50 (on the axis of the antenna) being approximately 3 dB greater than isotropic. The beamwidth, as defined by gain within 3 dB of the gain at the zenith, is approximately 120°, as shown by the 3 dB line 52 and the beamwidth limits 54. Similar results are obtained at different azimuth angles.

What is claimed is:

1. A dielectrically loaded multifilar antenna having an operating frequency in excess of 200 MHz, comprising: an electrically insulative core of a solid material that has a relative dielectric constant of at least 10 and occupies the major part of the interior volume defined by the core outer surface, and a three-dimensional antenna element structure that is on or adjacent the core outer surface and that comprises at least two pairs of substantially helical conductive antenna elements, the antenna elements being spaced apart around an axis of the antenna, wherein each such pair of antenna elements forms part of a conductive loop having an effective electrical length in the region of N guide wavelengths at the operating frequency, where N is an integer and is at least 2, the antenna having a 3 dB beamwidth of at least 90° for circularly polarized radiation.

2. An antenna according to claim 1, wherein the relative dielectric constant of the solid material is at least 20.

3. An antenna according to claim 1, wherein the 3 dB beamwidth for circularly polarized radiation is at least 120°.

4. An antenna according to claim 1, wherein the antenna element structure has at least three said pairs of substantially helical antenna elements.

5. An antenna according to claim 1, wherein each of at least some of the substantially helical antenna elements executes substantially a full turn around the antenna axis, the antenna elements being substantially uniformly spaced apart around the antenna axis and substantially axially coextensive.

6. An antenna according to claim 1, wherein:

the core has a cylindrical outer surface portion, a first end surface portion, and a second end surface portion that is oppositely directed with respect to the first end surface portion;

each said pair of helical antenna elements comprises two elongate conductive elements on the cylindrical outer surface portion of the core diametrically opposed with respect to each other;

the antenna includes a central feeder connection associated with the first end surface portion; and the antenna element structure includes a plurality of radially extending connecting elements on or adjacent the first end surface portion each coupling a respective one of the helical elements to the feeder connection, the lengths of the connecting elements being different for each said pair of helical antenna elements in order that the electrical length of the conductive loop containing each respective pair is different.

7. An antenna according to claim 6, having four pairs of helical antenna elements, the antenna further comprising a pair of antenna element coupling nodes, each said pair of helical antenna elements having a first antenna element connected to one of the coupling nodes and a second antenna element connected to the other coupling node, the four first antenna elements being located next to each other as a first group of antenna elements and the four second antenna elements being located next to each other as a second group of antenna elements, and wherein the radially extending connecting elements of each group progressively decrease in length in a predetermined direction around the periphery of the first end surface portion, the sense of the progression being the same for each group thereby to create a monotonic progression around the core in the lengths of the conductive loops.

8. An antenna according to claim 7, wherein the radially extending connecting elements form part of a conductive foil on or adjacent the first end surface portion of the core, the foil having two inner conductive arcs each interconnecting the feeder-connecting elements associated with a respective one of the groups of helical antenna elements.

9. An antenna according to claim 1, wherein the antenna element structure includes a common interconnecting conductor to which each of the antenna elements is connected and which encircles the core, the common interconnecting conductor defining a conductive path around the core to which the antenna elements are connected at substantially equally spaced connection points.

10. An antenna according to claim 9, wherein the electrical length of the said conductive path is substantially equal to a whole number (1, 2, 3, . . . ) of guide wavelengths corresponding to the operating frequency.

11. An antenna according to claim 1, wherein the average axial extent of the helical antenna elements is less than $\lambda/4$, where $\lambda$ is the wavelength in air of electromagnetic waves at the operating frequency.

12. An antenna according to claim 11, wherein the average axial extent of the helical elements is less than $\lambda/6$.

13. An antenna according to claim 1, wherein the spacing between the helical elements of each pair, measured perpendicularly to the axis, is about one half of the average axial extent of the helical elements.

14. An antenna according to claim 1, having an operating frequency in the region of from 1616 MHz to 1626.5 MHz.

15. A portable wireless communication terminal including an antenna according to claim 1.

16. A dielectrically loaded multifilar antenna having an operating frequency in excess of 200 MHz comprising: an electrically insulative core of a solid material that has a relative dielectric constant of at least 10 and occupies the major part of the interior volume defined by the core outer surface, and a three-dimensional antenna element structure that is on or adjacent the core outer surface and that comprises at least two pairs of substantially helical conductive antenna elements, the antenna elements being spaced apart around an axis of the antenna, wherein each of at least some of the substantially helical antenna elements executes substantially a full turn around the antenna axis, the antenna elements being substantially uniformly spaced apart around the antenna axis and substantially axially coextensive.

17. An antenna according to claim 16, having a 3 dB beamwidth of at least 90° for circularly polarized radiation.

18. An antenna according to claim 16, wherein the relative dielectric constant of the solid material is at least 20.

19. An antenna according to claim 16, wherein the 3 dB beamwidth for circularly polarized radiation is at least 120°.

20. An antenna according to claim 16, wherein the antenna element structure has at least four said pairs of substantially helical antenna elements.

21. An antenna according to claim 16, wherein:

the core has a cylindrical outer surface portion, a first end surface portion, and a second end surface portion that is oppositely directed with respect to the first end surface portion;

each said pair of helical antenna elements comprises two elongate conductive elements on the cylindrical outer surface portion of the core diametrically opposed with respect to each other;

the antenna includes a central feeder connection associated with the first end surface portion; and the antenna element structure includes a plurality of radially extending connecting elements on or adjacent the first end surface portion each coupling a respective one of the helical elements to the feeder connection, the lengths of the connecting elements being different for each said pair of helical antenna elements in order that the electrical length of the conductive loop containing each respective pair is different.

22. An antenna according to claim 21, having four pairs of helical antenna elements, the antenna further comprising a pair of antenna element coupling nodes, each said pair of helical antenna elements having a first antenna element connected to one of the coupling nodes and a second antenna element connected to the other coupling node, the four first antenna elements being located next to each other as a first group of antenna elements and the four second antenna elements being located next to each other as a second group of antenna elements, and wherein the radially extending connecting elements of each group progressively decrease in length in a predetermined direction around the periphery of the first end surface portion, the sense of the progression being the same for each group thereby to create a monotonic progression around the core in the lengths of the conductive loops.

23. An antenna according to claim 22, wherein the radially extending connecting elements form part of a conductive foil on or adjacent the said first end surface portion of the core, the foil having two inner conductive arcs each interconnecting the feeder-connecting elements associated with a respective one of the groups of helical antenna elements.

24. An antenna according to claim 16, wherein the antenna element structure includes a common interconnecting conductor to which each of the antenna elements is connected and which encircles the core, the common interconnecting conductor defining a conductive path around the core to which the antenna elements are connected at substantially equally spaced connection points.

25. An antenna according to claim 24, wherein the electrical length of the said conductive path is substantially equal to a whole number (1, 2, 3, . . . ) of guide wavelengths corresponding to the operating frequency.

* * * * *